United States Patent [19]

Nagase

[11] 4,180,888

[45] Jan. 1, 1980

[54] DOOR CLOSER

[75] Inventor: Toshiro Nagase, Sagamihara, Japan

[73] Assignee: Tokico Ltd., Kanagawa, Japan

[21] Appl. No.: 886,584

[22] Filed: Mar. 14, 1978

[30] Foreign Application Priority Data

Mar. 19, 1977 [JP] Japan ..... 52/33999

[51] Int. Cl.[2] ..... E05F 3/22

[52] U.S. Cl. ..... 16/58; 16/DIG. 9; 16/DIG. 10; 16/DIG. 21

[58] Field of Search ..... 16/49, 51, 58, 62, 64, 16/69, 79, 52, DIG. 9, DIG. 10, DIG. 21

[56] References Cited

U.S. PATENT DOCUMENTS

| | | | |
|---|---|---|---|
| 3,446,317 | 5/1969 | Gryglas | 16/51 X |
| 3,487,494 | 1/1970 | Baan et al. | 16/51 |
| 3,584,331 | 6/1971 | D'Hooge | 16/51 X |
| 3,742,553 | 7/1973 | Sittmann | 16/51 X |
| 3,822,438 | 7/1974 | Takenaka | 16/62 |
| 3,997,037 | 12/1976 | Schupner | 16/51 X |
| 4,075,734 | 2/1978 | Nagase | 16/58 |

FOREIGN PATENT DOCUMENTS

| | | | |
|---|---|---|---|
| 2522996 | 12/1975 | Fed. Rep. of Germany | 16/62 |
| 2279917 | 2/1976 | France | 16/62 |

*Primary Examiner*—Werner H. Schroeder
*Assistant Examiner*—Moshe I. Cohen
*Attorney, Agent, or Firm*—Wenderoth, Lind & Ponack

[57] ABSTRACT

A door closer includes a horizontally disposed inner cylinder receiving oil therein, an outer cylinder surrounding the inner cylinder and receiving gas and oil in an annular spaced defined around the inner cylinder, a piston slidably fitted in the inner cylinder, a piston rod secured to the piston and extending out of the cylinders for connection to a door, a passage disposed at one end of the inner cylinder for communicating the interior of the inner cylinder with the annular space, a valve member movably mounted on the piston rod and normally at a position spaced from the piston for cooperating with the passage so as to reduce the effective passage area of the passage in the end portion of outward movement of the piston rod relative to the cylinders.

2 Claims, 1 Drawing Figure

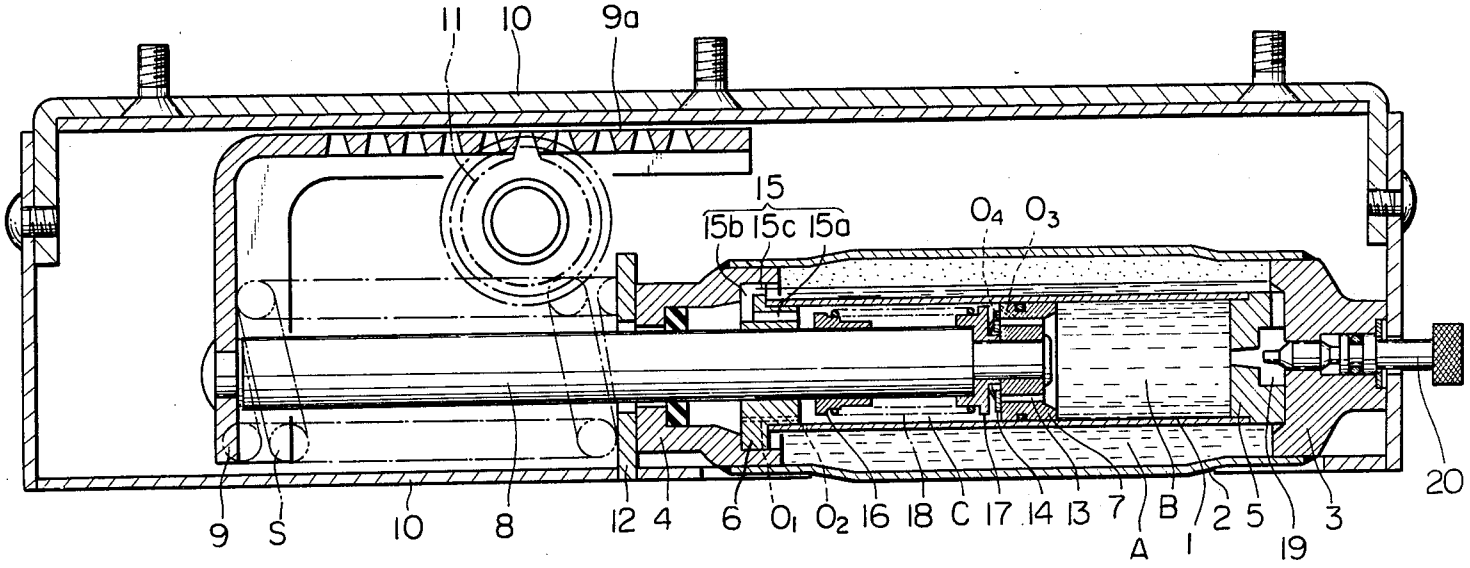
20
3
19
5
2
1
B
A
7
13
14
17
C
18
16
$O_2$
$O_1$
6
4
12
8
10
S
9
$O_3$
$O_4$
15
15a
15b
15c
9a
10
11

DOOR CLOSER

BACKGROUND OF THE INVENTION

This invention relates to a door closer and, more particularly, to a door closer for developing a door closing force which causes the door to be closed at a normal closing speed and then at a slower latching speed.

One prior art door closer of the type aforementioned is shown in U.S. Pat. No. 3,042,957, which works satisfactorily, but the construction thereof is very complicated and, accordingly, it is expensive. The applicant of the present invention has proposed a hydraulically actuating door closer to a simple construction in U.S. Pat. No. 4,075,734 and, the present invention relates to improvements in such door closers.

BRIEF SUMMARY OF THE INVENTION

An object of the present invention is to provide a hydraulically actuated door closer of the type aforementioned, but with a simple construction.

According to the present invention, there is provided a door closer having an inner cylinder receiving oil therein, an outer cylinder surrounding the inner cylinder to define therebetween an annular space receiving gas and oil therein, a piston slidably fitted in the inner cylinder and dividing the interior of the inner cylinder into two oil chambers, a piston rod secured to the piston and extending through one of the oil chambers and out of the inner cylinder for connection to a door, spring means urging the piston rod outwardly of the inner cylinder and adapted to store resilient force when the piston rod is moved into the inner cylinder, a passage in one end of the inner cylinder for communicating the one oil chamber with the annular space, and a valve member movably mounted on the piston rod in the one oil chamber for reducing the effective area of the passage at a position adjacent the end of the outward movement of the piston rod.

BRIEF DESCRIPTION OF THE DRAWING

The present invention will be described in detail in conjunction with the single accompanying drawing which illustrates a longitudinal cross-sectional view of a door closer exemplifying the present invention.

DETAILED DESCRIPTION OF THE PREFERRED EMBODIMENT

The door closer shown in the drawing comprises an inner cylinder 1 and a co-axial outer cylinder 2 spaced therefrom. The opposite ends of the outer cylinder 2 are closed by end caps 3 and 4 respectively. An end plug 5 and a rod guide 6 are fitted respectively in the opposite ends of the inner cylinder 1 and are disposed respectively between the end caps 3 and 4 and the inner cylinder 1.

A piston 7 is slidably fitted in the inner cylinder 1 and divides the interior of the inner cylinder 1 into two oil chambers B and C. An annular chamber A is defined between the inner and the outer cylinders 1 and 2 and receives oil and gas therein. A piston rod 8 secured to the piston 7 extends through the oil chamber C, the rod guide 6, the end cap 4 and projects out of the cylinder 2. An actuating plate 9 is secured to the projecting end of the rod 8. Rack teeth 9a are formed in the actuating plate 9 for cooperating with a pinion 11. The pinion 11 is rotatably mounted in a casing 10, and is adapted to be connected to a door (not shown) through a suitable link mechanism or the like which is not shown in the drawing. The casing 10 may be secured to a door frame (not shown) when the pinion 11 is connected to the door. The inner cylinder 1, the outer cylinder 2, end caps 3 and 4, the end plug 5 and the rod guide 6 are assembled integrally and mounted fixedly in the casing 10 by a fixing member 12.

The gas enclosed in the annular chamber A is high pressure air or gas and acts to compensate for the change in volume in the inner cylinder 1 caused by ingress or exit of the piston rod 8 with respect to the inner cylinder 1 and, acts also as spring means or restoring force means affording the rod 8 a force corresponding to the pressure of the gas multiplied by the cross-sectional area of the rod 8.

The oil chamber B is connected to the oil chamber C through passages 13 formed in the piston 3 and a check valve 14 normally closing the passages 13 and allowing oil flow from the chamber B to the chamber C. The valve 14 prevents oil flow from the chamber C to the chamber B.

An oil passage 15 is formed in the rod guide 6 to connect the oil chamber C with the annular chamber A and consists of an axial opening **15*a* piercing through the rod guide 6, a radial groove 15*b* formed in the outer side surface of the rod guide 6, and an axial groove 15*c* formed in the outer periphery of the rod guide 6 and being connected to the radial groove 15*b***.

A valve member 16 is slidably mounted on the piston rod 8 according to the present invention. The valve member 16 is attached to one end of a spring 18 and the other end of the spring 18 is attached to a spacer 17 which is fitted on the piston rod 8. The spring 18 has a weak spring constant and the free length of spring 18 normally defines the distance between the valve member 16 and the spacer 17 or the position of the valve member 16 with respect to the piston rod 8. In the illustrated embodiment the spring 18 is attached to the spacer 17, but the spring 18 may be secured to the piston 7 or to the piston rod 8 at a position adjacent to the piston 7. The valve member 16 is adapted to engage with the rod guide 6 at a position adjacent to the end of projecting stroke or the leftward movement of the piston rod 8 so as to reduce the effective passage area of the passage **15*a***.

A passage 19 is formed in the end cap 3 and the end plug 5 to communicate the oil chamber B and the annular chamber A, and an adjusting valve 20 operable from the outside of the door closer is disposed in the passage 19.

With the door closer having the aforesaid construction, when the door is opened the piston rod 8 moves rightward in the drawing which shows the door closer in an intermediate position, and gas enclosed in the annular chamber A is compressed in response to the ingress of the rod 8 into the cylinder 1. Oil in the oil chamber B flows into the oil chamber C through the passages 13 by opening the check valve 14 and also flows into the annular chamber A through the passage 19 without causing any substantial damping force. Therefore, the amount of liquid (oil) in the annular chamber A increases in response to the ingress of the piston rod 8 into the cylinder 1, and the pressure of the gas in the chamber A increases accordingly and a door closing or restoring force is stored in the chamber A which acts on the piston rod 8.

It will be noted that in the initial stage of the door opening movement, the valve member 16 engages with the rod guide 6 to reduce the effective passage area of the passage 15, but an amount of oil corresponding to the ingress of the piston rod will flow into the chamber A through the passage 19, and no oil flow will occur in the passage 15. When the piston rod 8 moves into the cylinder by a distance exceeding the free length of the spring 18 the valve member 16 separates from the rod guide 6.

When the door thus opened is released, the pressure of the gas in the chamber A acts on the piston rod 8 to move it leftward in the drawing, whereby the door is moved in the closing direction through the actuating plate 9, the pinion 11 and lever or the like. In the door closing movement, the oil in the oil chamber C flows into the chamber A through the fully open passage 15 without causing any substantial resistance, and oil in the annular chamber A flows into the oil chamber B through the passage 19 to generate a resisting force determined by the opening of the valve 20, whereby the moving speed of the piston rod 8 or the door closing speed is controlled. When the piston rod 8 approaches the end of the leftward movement, the valve member 16 abuts the rod guide 6. Thereafter, the piston rod 8 continues the movement in the same direction with the spring 18 being compressed. During this stage of the movement of the piston rod 8, the effective passage area of the passage 15 is reduced by the valve member 16, thus generating a high resisting force against the oil flowing from the chamber C to the chamber A across the passage 15. Thus the door closing speed is reduced substantially.

As described heretofore, the door closer according to the present invention makes it possible to close a door at a relatively large speed from the fully open position to a position adjacent to the fully closed position and at a slow speed from the position adjacent to the fully closed position to the fully closed position, with a very simple construction. The stroke of the slow speed movement or the position adjacent to the fully closed position can be changed easily by changing the length of the spring 18.

In the illustrated embodiment, the valve member 16 does not close the opening 15*a* completely, but the valve member 16 may be formed to close the opening 15*a* completely provided that a suitable orifice such as either of orifices $O_1$, $O_2$, $O_3$ or $O_4$ is formed to permanently connect the oil chamber C with the chambers A or B so as to generate a resisting force when the valve member 16 engages with the rod guide 6 at the end portion of the door closing movement. The orifice $O_1$ is an axial opening formed in the rod guide 6 to connect the opposite sides thereof, and the orifice $O_2$ is a radial opening formed in the peripheral wall of the inner cylinder 1. And the orifices $O_3$ and $O_4$ are adapted to connect the oil chambers B and C permanently.

The passages 13 and the check valve 14 may be omitted so that the chambers B and C do not communicate directly.

In the illustrated embodiment, high pressure gas is enclosed in the chamber A to act as spring means providing the door closing force, but it is possible to reduce the gas pressure by providing a metal spring S.

As described heretofore, the door closer of the present invention operates satisfactorily with a very simple construction, and it is easy to change the operational characteristics of a particular door closer.

What is claimed is:

1. A door closer comprising:

an inner cylinder receiving therein oil;

an outer cylinder surrounding said inner cylinder and defining therebetween an annular chamber receiving therein gas and oil;

a piston slidably fitted within said inner cylinder and dividing the interior of said inner cylinder into first and second oil chambers;

a piston rod secured to said piston and extending through said first oil chamber and out of said inner cylinder for connection to a door;

said piston rod being movable inwardly of said inner cylinder to a first position whereat said piston reduces the size of said second oil chamber, and said piston rod being movable outwardly of said inner cylinder to a second position whereat said piston reduces the size of said first oil chamber;

restoring force means for storing a restoring force when said piston rod is moved toward said first position and for urging said piston rod to be moved to return toward said second position;

passage means in an end of said inner cylinder for providing fluid connection between said first oil chamber and said annular chamber;

valve member means, slidably mounted on said piston rod within said first oil chamber, for cooperating with said passage means and for reducing the effective passage area thereof when said piston rod reaches a position adjacent said second position thereof; and spring member means, having opposite ends thereof connected to said piston and to said valve member means, for normally retaining said valve member means in a position spaced from said piston.

2. A door closer as claimed in claim 1, wherein said inner and outer cylinders are disposed horizontally.

* * * * *